US010709268B2

(12) United States Patent
Woodson

(10) Patent No.: US 10,709,268 B2
(45) Date of Patent: Jul. 14, 2020

(54) SLIDING COLLAPSABLE SHOE TREE

(71) Applicant: Terri Lynn Woodson, Marina Del Rey, CA (US)

(72) Inventor: Terri Lynn Woodson, Marina Del Rey, CA (US)

( * ) Notice: Subject to any disclaimer, the term of this patent is extended or adjusted under 35 U.S.C. 154(b) by 0 days.

(21) Appl. No.: 15/913,883

(22) Filed: Mar. 6, 2018

(65) Prior Publication Data

US 2018/0271304 A1 Sep. 27, 2018

Related U.S. Application Data

(60) Provisional application No. 62/467,725, filed on Mar. 6, 2017.

(51) Int. Cl.

| | |
|---|---|
| ***A47F 7/08*** | (2006.01) |
| ***A47F 5/02*** | (2006.01) |
| ***A47B 61/04*** | (2006.01) |

(52) U.S. Cl.

CPC ..... *A47F 7/08* (2013.01); *A47B 61/04* (2013.01); *A47F 5/02* (2013.01)

(58) Field of Classification Search

CPC ..... A47F 5/04; A47F 5/05; A47F 5/06; A47F 7/08; A47F 5/02; A47G 25/005; A47G 25/0664; A47G 25/0685; A47G 25/06; A47B 61/04

USPC ..... 211/196, 205, 107, 133.4, 34, 37, 38

See application file for complete search history.

(56) References Cited

U.S. PATENT DOCUMENTS 179,610 A * 7/1876 Robinson ..... D06F 57/04 211/171
314,460 A * 3/1885 Meredith ..... F26B 21/006 34/104
345,741 A * 7/1886 Thurston ..... A47F 5/06 211/172
353,332 A * 11/1886 Tremble ..... D06F 57/04 211/171
392,259 A * 11/1888 Carr ..... A47G 25/18 211/116
406,163 A * 7/1889 Faries ..... A47B 11/00 108/94
430,970 A * 6/1890 Reed ..... D06F 57/04 211/167
459,583 A * 9/1891 Johnson ..... A47G 25/32 248/340
723,114 A * 3/1903 Witt ..... A47F 5/04 211/205

(Continued)

*Primary Examiner* — Jonathan Liu
*Assistant Examiner* — Devin K Barnett
(74) *Attorney, Agent, or Firm* — Law Office of Dorian Cartwright; Dorian Cartwright

(57) ABSTRACT

A shoe tree comprises a vertical trunk member with a handle. Multiple horizontal branches are spaced along a span of the trunk, in various possible configurations. The horizontal branch has a rigid portion that extends in a generally perpendicular manner from the vertical trunk member. The handle allows the shoe tree to be easily slid under, and retrieved from under, a bed. The horizontal branch also has a rotatable portion on each end that extends from an end of the horizontal branch on one end and is connected by a living hinge. In operation, a shoe bag slides onto the rotatable portion and is then locked into place. When locked into place, the overall space consumed by the shoe tree is much smaller.

3 Claims, 4 Drawing Sheets

(56) References Cited

U.S. PATENT DOCUMENTS 724,582 A * 4/1903 Jones ..... A47F 5/06 211/172
734,995 A * 7/1903 Sullivan ..... A47F 5/02 108/1
768,363 A * 8/1904 Harrell ..... A47F 5/06 211/172
904,758 A * 11/1908 Cropp ..... A47G 25/0664 178/2 R
921,932 A * 5/1909 Wenzelmann ..... A01F 25/12 211/113
963,893 A * 7/1910 Hegarty ..... A47F 5/06 211/172
983,589 A * 2/1911 Wendt ..... A47G 25/0664 211/172
1,038,198 A * 9/1912 Randell ..... A47F 5/04 211/205
1,069,643 A * 8/1913 Inden ..... A47F 5/06 211/172
1,073,763 A * 9/1913 Kalitzky ..... A47G 25/0664 211/196
1,074,888 A * 10/1913 McIver ..... F26B 21/006 12/123
1,107,075 A * 8/1914 Karges ..... A61B 6/4464 211/196
1,156,699 A * 10/1915 Maxwell ..... A47F 5/06 211/172
1,292,314 A * 1/1919 Hays ..... A47F 5/02 211/163
1,492,944 A * 5/1924 Talley ..... A47F 5/05 211/166
D67,680 S * 6/1925 Ziegler ..... 211/33
1,563,137 A * 11/1925 Amsler ..... D06F 57/04 211/205
1,583,784 A * 5/1926 Erickson ..... A47F 7/08 211/163
1,713,673 A * 5/1929 Nelson ..... D06F 57/04 248/170
1,832,730 A * 11/1931 Pack ..... A47G 25/08 211/171
1,909,942 A * 5/1933 Fingerman ..... A45C 3/12 206/278
2,125,045 A * 7/1938 Connelly ..... A47F 7/08 211/163
2,528,003 A * 10/1950 Katzberg ..... A45B 25/08 135/39
2,542,137 A * 2/1951 Hanson ..... A47F 7/24 126/30
2,628,760 A * 2/1953 Stevens ..... B65B 67/10 211/196
2,631,802 A * 3/1953 Tunis ..... A47F 5/06 108/159
2,708,324 A * 5/1955 Wedden ..... A47G 33/06 211/1
2,780,260 A * 2/1957 Watson ..... A47G 25/005 383/23
2,832,389 A * 4/1958 Smith ..... A47G 25/005 383/39
2,845,185 A * 7/1958 Winderweedle, Jr. ..... A47G 25/005 108/149
3,132,747 A * 5/1964 Van Duyne ..... A47F 5/06 211/189
D202,677 S * 10/1965 Hagle ..... D6/681.3
3,210,787 A * 10/1965 Allsop ..... A43D 3/1416 12/120.5
3,421,762 A * 1/1969 Paradise ..... A63F 9/0208 211/107
3,806,399 A * 4/1974 Cocjin ..... A47G 33/06 211/196
3,846,213 A * 11/1974 Theimann ..... A47G 33/06 135/31
4,390,099 A * 6/1983 Trautlein ..... A47F 7/02 211/163
D271,913 S * 12/1983 Nanfito ..... D32/55
4,429,861 A * 2/1984 Range ..... A24B 1/00 209/704
4,468,421 A * 8/1984 Wang ..... A47G 33/06 211/205
4,496,615 A * 1/1985 Huang ..... A47G 33/06 211/196
4,659,597 A * 4/1987 Lau ..... A47G 33/06 211/196
4,889,246 A * 12/1989 Lee ..... A47F 5/02 211/163
5,015,510 A * 5/1991 Smith ..... A47G 33/06 211/196
5,054,622 A * 10/1991 Lee ..... A47G 25/0664 211/196
5,065,871 A * 11/1991 Chan ..... A43D 3/1491 12/128 B
5,219,081 A * 6/1993 Lin ..... A47G 25/0664 211/196
5,318,175 A * 6/1994 Stevens ..... A47G 25/0664 211/107
5,377,849 A * 1/1995 Martin ..... A47F 8/02 211/85.7
5,458,249 A * 10/1995 Shang-Lu ..... D06F 57/04 211/196
5,469,635 A * 11/1995 Lamontagne ..... F26B 21/006 34/104
5,655,669 A * 8/1997 Moore ..... A47F 3/147 211/34
D383,334 S * 9/1997 Barden ..... D6/681.3
5,862,924 A * 1/1999 Dumont ..... A47F 5/04 211/118
6,308,838 B1 * 10/2001 Endean ..... A47F 7/08 211/205
6,386,491 B1 * 5/2002 Bissett ..... A47F 5/04 211/205
D465,946 S * 11/2002 Boyd, Jr. ..... D6/681.3
6,568,546 B1 * 5/2003 Huang ..... A47B 49/00 211/205
6,644,484 B1 * 11/2003 Sardis ..... A47B 43/00 211/189
6,698,596 B1 * 3/2004 Dean ..... A47F 5/02 211/13.1
6,698,598 B1 * 3/2004 Appenteng ..... A47F 5/02 211/168
6,702,129 B1 * 3/2004 Harris ..... A47G 25/0664 211/172
6,814,093 B2 * 11/2004 You ..... A45B 25/02 135/23
6,854,609 B1 * 2/2005 Hettinger ..... A47F 7/0071 211/85.4
6,902,139 B2 * 6/2005 Wang ..... D06F 57/12 211/196
6,948,629 B1 * 9/2005 McClay ..... A47B 46/00 211/1.51
7,165,689 B2 * 1/2007 McDaniel ..... A47B 96/061 211/116
7,458,475 B2 * 12/2008 Ho ..... A47G 7/041 211/182
7,467,481 B2 * 12/2008 Christian ..... A47L 23/205 34/104
8,240,488 B2 * 8/2012 Huang ..... B05B 13/0292 211/107
8,418,860 B2 * 4/2013 Rimmer ..... D06F 57/08 211/196
9,010,703 B2 * 4/2015 Tresserras Picas ..... E04H 12/24 248/218.4
9,402,471 B1 * 8/2016 Gonzalez Ruiz ..... A47B 61/04
9,518,696 B1 * 12/2016 Lin ..... F16M 11/38
9,909,250 B1 * 3/2018 Greenspon ..... A47G 25/0685
10,034,544 B2 * 7/2018 Berger ..... A47B 81/00
10,094,064 B2 * 10/2018 Champagne ..... A47B 43/00
2003/0164348 A1 * 9/2003 Seng ..... D06F 57/04 211/196

(56) References Cited

U.S. PATENT DOCUMENTS

| | | | | |
|---|---|---|---|---|
| 2004/0134870 | A1* | 7/2004 | Daubach | D06F 57/04 211/196 |
| 2004/0181963 | A1* | 9/2004 | Morris | D06F 59/04 34/103 |
| 2005/0247836 | A1* | 11/2005 | Park | A47F 5/04 248/214 |
| 2006/0065613 | A1* | 3/2006 | McKay | A47F 5/02 211/85.2 |
| 2006/0186073 | A1* | 8/2006 | Roe | D06F 59/02 211/196 |
| 2006/0186074 | A1* | 8/2006 | Bair | A47F 5/04 211/205 |
| 2008/0061016 | A1* | 3/2008 | Nicolopulos | A47F 5/02 211/62 |
| 2009/0071922 | A1* | 3/2009 | Barra | F16M 11/28 211/85.3 |
| 2010/0193451 | A1* | 8/2010 | Levine | A47F 5/04 211/37 |
| 2010/0300900 | A1* | 12/2010 | Quan | A45C 11/16 206/6.1 |
| 2013/0055510 | A1* | 3/2013 | Bao | A43D 3/1416 12/128 R |
| 2013/0082016 | A1* | 4/2013 | Arrow | A47G 25/0671 211/85.1 |
| 2014/0021152 | A1* | 1/2014 | Carver | A47G 25/08 211/85.3 |

* cited by examiner

SLIDING COLLAPSABLE SHOE TREE

CROSS-REFERENCE TO RELATED PATENT APPLICATION

This application claims priority to U.S. Provisional Patent Application No. 62/467,725, filed Mar. 6, 2017, entitled SLIDING COLLAPSABLE SHOE TREE by Terri Lynn Woodson, the contents of which is hereby incorporated by reference in its entirety.

TECHNICAL FIELD

The disclosed subject matter relates, generally, to storage apparatus, and more particularly, an improved shoe storage apparatus that folds into a compact form factor and slides away for long-term storage and slides out for shoe selection.

BACKGROUND

Shoes and other apparel can quickly cause clutter and safety hazards when left out in open areas of a home. Avid shoppers can have 10 or 20 or more pairs of shoes that are not often worn.

Closet floors typically have only limited space that can be used for shoes. Further, the matching pairs of shoes together can be easily separated and unorganized. Shoe boxes are individual and, when stacked, can easily fall down. For example, a whole column of shoe boxes can fall by trying to fish out a shoe box at the bottom of the column. Conventional shoe storage apparatus is often bulky, such as vertical shoe trees that take away from clothing storage and horizontal shoe trees that take away from floor space.

Therefore, what is needed is a robust shoe tree that addresses these problems of conventional shoe storage techniques.

BRIEF SUMMARY

To address the above-mentioned shortcomings, a sliding shoe tree and a storage method are disclosed.

In one embodiment, the shoe tree comprises a vertical trunk member with a handle. Multiple horizontal branches are spaced along a span of the trunk, in various possible configurations. The horizontal branch has a rigid portion that extends in a generally perpendicular manner from the vertical trunk member. The handle allows the shoe tree to be easily slid under, and retrieved from under, a bed.

In another embodiment, the horizontal branch also has a rotatable portion on each end that extends from an end of the horizontal branch on one end and is connected by a living hinge. In operation, a shoe bag slides onto the rotatable portion and is then locked into place. When locked into place, the overall space consumed by the shoe tree is much smaller.

In still another embodiment, the horizontal branches can be moved up and down the vertical trunk member to adjust relative spacing between shoes when folded into storage mode.

Advantageously, shoes can be more easily stored. The shoe trees collapse and mate to store many shoes in an organized space. The shoe trees can also be collapsed and stood up in a closet, out of the way.

BRIEF DESCRIPTION OF THE DRAWINGS

In the following drawings, like reference numbers are used to refer to like elements. Although the following figures depict various examples of the invention, the invention is not limited to the examples depicted in the figures.

DETAILED DESCRIPTION

A shoe tree collapsible for improved shoe storage, and related methods, are described. It will be understood by one of ordinary skill in the art that the embodiments described herein may be adapted and modified as is appropriate for the application being addressed and that the embodiments described in more detail below may be employed in other suitable applications, and that such other additions and modifications will not depart from the scope hereof.

Figures 1, 2:
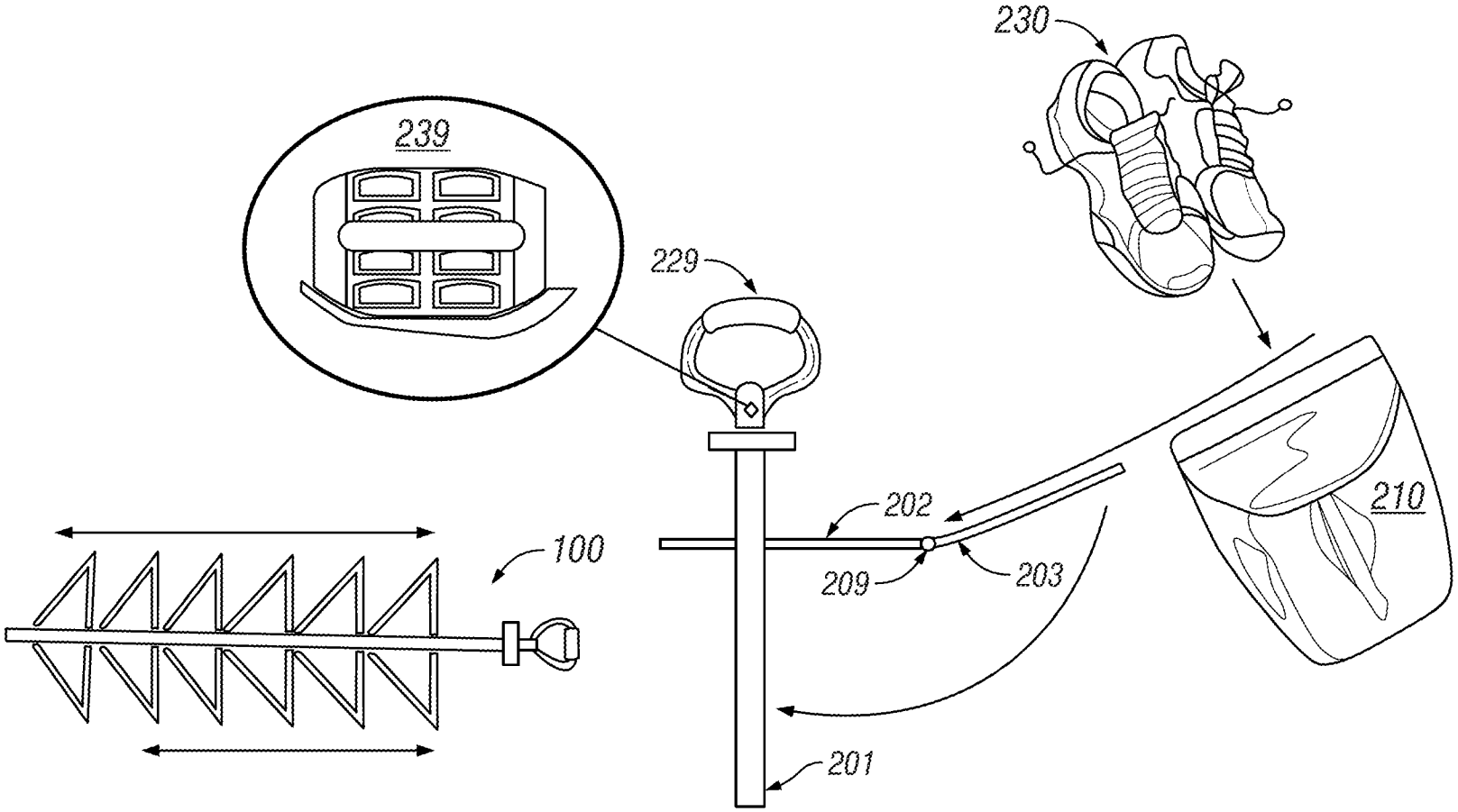
FIG. 1 is a side view of a shoe tree, according to an embodiment.
FIG. 2 is a side view of a rotating branch on the shoe tree of FIG. 1, according to an embodiment.

FIG. 1 is a side view of a shoe tree 100, according to an embodiment. The shoe tree 100 has a vertical (or non-vertical) trunk member 201 (or 301) with a handle 229. Multiple horizontal (or non-horizontal) branches 202 (or 302) are spaced along a span of the trunk, in various possible configurations. The horizontal branch has a rigid portion that extends in a generally perpendicular manner from the vertical trunk member. A shoe bag 210 for shoes 230 slides onto a shoe support member 203 (or 303) coupled to each of the horizontal branches. The horizontal branches also have a rotatable portion which rotates to lock the shoe bag 210 into the shoe tree 100 for storage.

The vertical trunk member can be an elongated structural support member having a proximal end and a distal end. The vertical trunk can be a single member or be composed of several section members. The vertical trunk member can be composed of steel, hard plastic, hard rubber, wood, or any other appropriate material for support. In one embodiment, the vertical trunk member supports two shoes, and in another embodiment, supports twenty shoes.

In one embodiment, the shoe tree 100 collapses when the horizontal branches are folded into place over a living hinge 209 (or 309, 409). The shoe tree 100 when unfolded can allow easier access for taking shoes in and out of the shoe bag 210, and when folded can allow compression of space taken up by the shoe tree 100.

In one embodiment, several shoe trees are stacked on top of each other. These stacked shoe trees can have interlocking components on one side of a bottom shoe tree, allowing an opposite side of a top shoe tree to be easily stacked into a supported configuration. A single shoe tree could store two to twenty or so pairs of shoes. A stacked shoe tree couple can be configured in an interlocking support to store over 100 pairs of shoes. For example, a first and a second side of a shoe tree can both mate to adjacent shoe trees. An interlocking mechanism can have mated sides that interlock when a female side of a first shoe tree mates with a male side of a second shoe tree. Many other variations are possible.

The handle allows the shoe tree 100 to be easily slid under, and retrieved from under, a bed. Therefore, rather than using closet space for shoe storage, the shoe tree 100 can be loaded up with shoe bags and slid under a bed for long-term storage. When it is time to retrieve a pair of shoes, the handle provides leverage for pulling out the shoe tree 100 from beneath the bed. The handle can also be adapted for hanging from a bedroom closet pole. In one embodiment, the handle is bolted to the vertical trunk member, on either side. In an embodiment, the handle has a digital display related to shoes currently stored there.

A label 239 maps out where each shoe is located. The label 239 can be manually generated or digitally generated. As a result, an exact shoe bag on the shoe tree 100 is identified for retrieving those shoes. In the event of multiple storage trees, the label 239 guides to a correct storage tree and to a shoe bag on that storage tree. One embodiment includes a smartphone mobile app for tracking locations of shoes within shoe tree configurations.

FIG. 2 is a side view of a rotatable portion attached to the horizontal branch on the shoe tree of FIG. 1, according to an embodiment. A direction of rotation for the rotatable portion locking into place is shown in FIG. 2. A triangle is formed by the vertical trunk member, the horizontal branch, and the rotatable portion. Of course, the triangle is just one example of various implementations. The members can be made of a sturdy steel or hard plastic material, or other appropriate material.

In another embodiment, a horizontal branch is attached to a vertical trunk member and has a rotatable portion that extends from an end of the horizontal branch on one end. Another end of the rotatable portion extends from the rigid portion end back to the vertical trunk member to generally form a triangle. In operation, a shoe bag 210 slides onto the rotatable portion and is then locked into place on a hypotenuse part of the triangle.

The shoe bag 210 can be a bag, a box, a net or any other type of appropriate container for shoes, boots, slippers, high heels, sandals, and the like. The shoe bag 210 can made of netting, vinyl, leather, plastic or any appropriate material. The shoe bag 210 can be self-supporting or wrapped around a frame. A Velcro or snap fastener can close the shoe bag 210 once the shoes 220 have been inserted. A tab on top of the shoe bag 210 is configured to slide onto the horizontal member. However, the shoes 220 can be put into and taken out of the shoe bag 210 without being removed from the horizontal member.

In one embodiment, several shoe trees are laid side-by-side under a bed. An additional row of shoe trees can be layered on top of a base row. In other embodiments, shoe trees are stored vertically.

Figure 3:
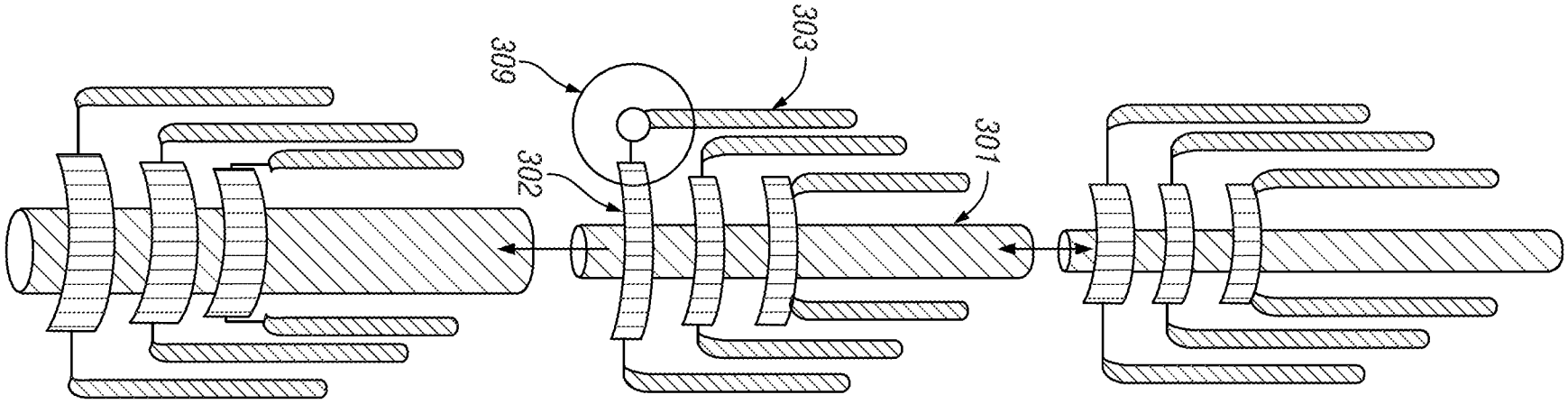
FIG. 3 is a side view of a shoe tree, according to a second embodiment.
Figure 4:
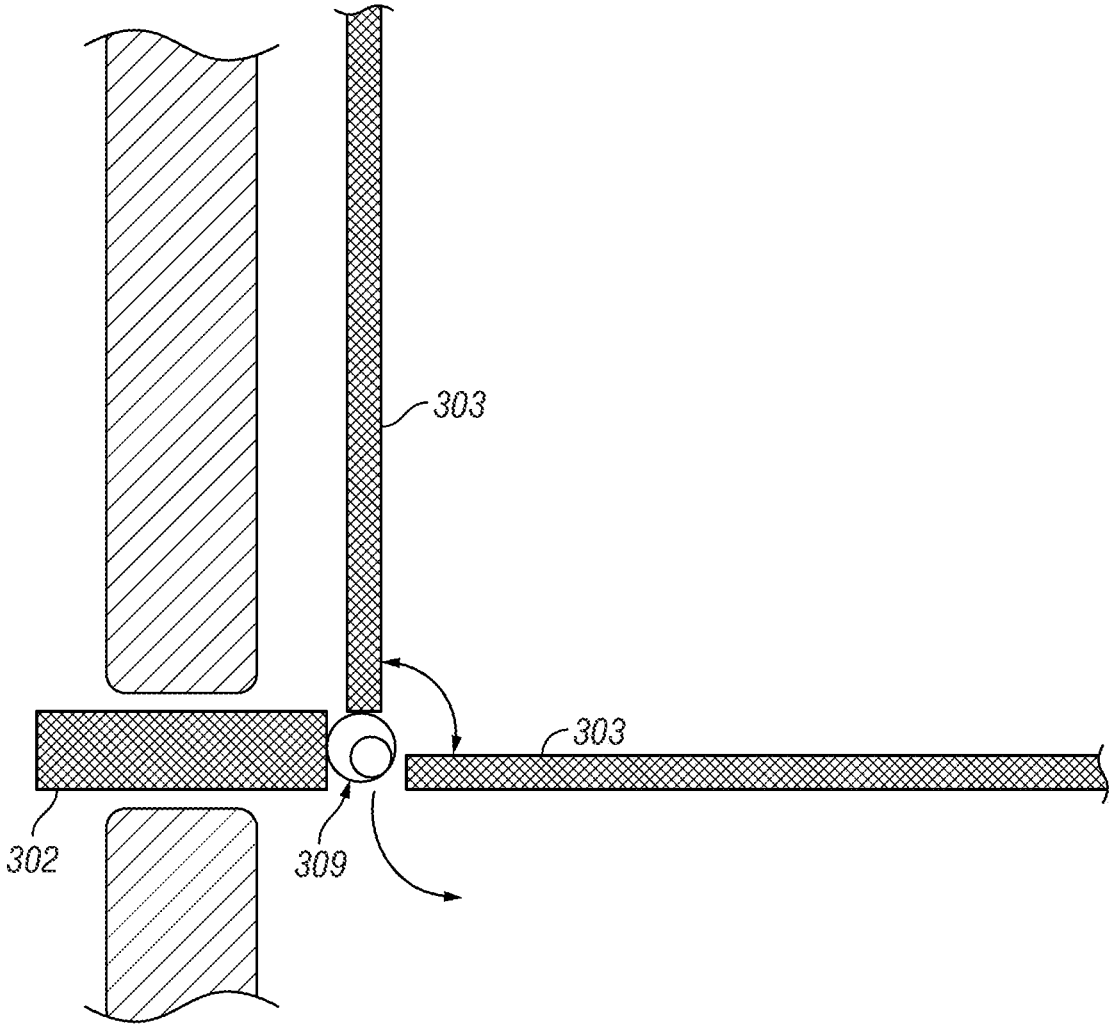
FIG. 4 is a side view of a rotating branch on the shoe tree of FIG. 3, according to the second embodiment.

FIGS. 3 and 4 illustrate yet another embodiment of a shoe tree. In this case, a vertical trunk member is pieced together in sections. For example, there can be just one section or ten sections. Each section of this instance includes three horizontal branches, each horizontal branch with two sides, to accommodate six pairs of shoes.

The horizontal branches of FIGS. 3 and 4 are not identically sized as is the embodiment in FIGS. 1 and 2. Instead, the three horizontal branches have openings that have successively larger diameters so to form a telescoping configuration or a nested configuration.

Further, a rotatable section locks into place generally parallel to the vertical trunk member rather than in a triangle shape (see rotating positions of shoe support member 303). The triangle shape for shoe space conserves space in storage mode compared to being open in access mode. One implementation uses a living hinge for rotation.

Figure 5:
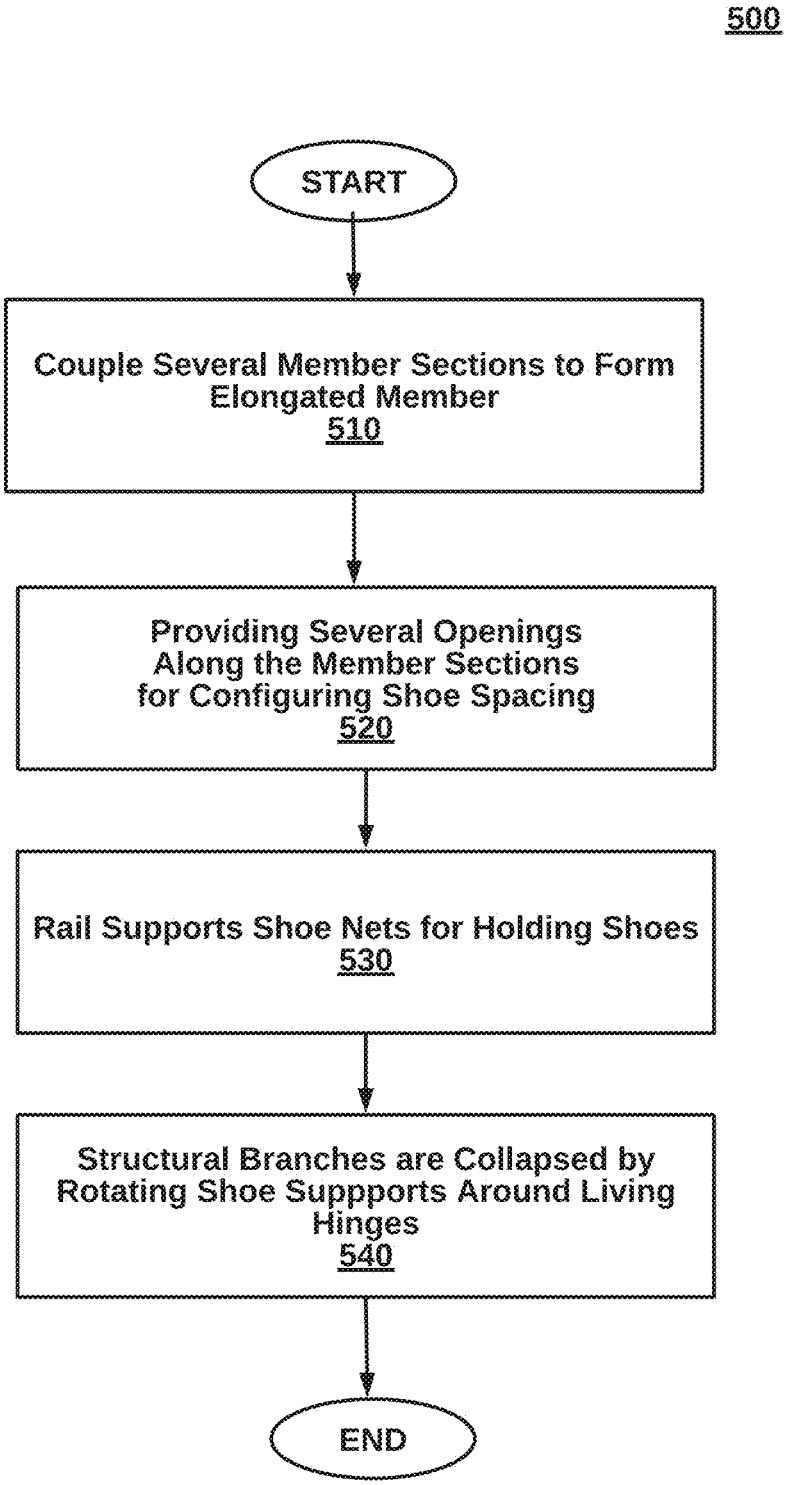
FIG. 5 is a flow chart illustrating a method of storing shoes in a shoe tree.

FIG. 5 is a flow chart illustrating a method 500 for shoe storage, according to an embodiment.

At step 510, several member sections are screwed into each other to form an elongated member, of desired length. Additional member sections can be screwed in to make the shoe tree longer for holding more shoes.

At step 520, structural branches are adjusted into place around appropriate member sections. Each of the member sections has several openings at different locations along a length of the member sections. The configuration allows a user to move structural branches, relative to each other, to form different spacing positions. For example, a pair of boots may need more space than slippers.

At step 530, shoe nets or other shoe containers slide on to a rail of a shoe support and attach to form a basket for holding shoes.

At step 540, the structural branches are collapsed by rotating the shoe supports around living hinges connecting either side of the base to the shoe supports. A button in the handle can activate collapsing, as well as opening, of the shoe tree. Once collapsed, the shoe tree is well formed for sliding underneath a bed or onto a shelf. Another option is to stand-up the shoe tree against a closet wall.

Optionally, a next step stacks shoe trees on top of each other or adjacent to each other, structurally connected and supported by an interlock mechanism connected to each shoe tree.

Although the invention has been described and illustrated in the foregoing illustrative embodiments, it is understood that the present disclosure has been made only by way of example, and that numerous changes in the details of implementation of the invention can be made without departing from the spirit and scope of the invention, which is only limited by the claims which follow. Features of the disclosed embodiments can be combined and rearranged in various ways.

The invention claimed is:

1. A shoe tree collapsible for easy storage, the shoe tree comprising:

an elongated structural trunk comprising a plurality of nested section members including a first nested section member, a second nested section member, and a third nested section member between a distal end and a proximal end, the plurality of nested section members coupled together to form the elongated structural trunk for supporting shoe weight from shoes stored on the shoe tree when in a standing mode;

the plurality of nested section members coupled in a telescoping configuration such that a first diameter of the first nested section member is smaller than a second diameter of the second nested section member, and the second diameter is smaller than a third diameter of the third nested section member, wherein one end of the first nested section member fits within one end of the second nested section member, and another end of the second nested section member fits within one end of the third nested section member; and each of the nested section members coupled to a plurality of structural branches in a nested formation, and each structural branch including a base, a living hinge, and an arm, wherein corresponding bases of corresponding structural branches are secured to each nested section member respectively and span away from the elongated structural trunk, wherein the corresponding bases of each nested section member have successively larger spans, wherein each arm rotates to allow the shoe tree to be collapsed from the standing mode to a storage mode, and wherein, in the standing mode, at least one of the arms is configured to hold a shoe container for storing a corresponding pair of shoes and, in the storage mode, each arm is substantially parallel with the elongated structural trunk.

2. The shoe tree of claim 1, wherein the elongated structural trunk is rigid and configured to support shoes fitting on the plurality of structural branches.

3. The shoe tree of claim 1, wherein the shoes are selected from a category comprising boots, slippers, sandals and loafers.

* * * * *